US006240592B1

(12) United States Patent
Li

(10) Patent No.: US 6,240,592 B1
(45) Date of Patent: Jun. 5, 2001

(54) WHEEL DETAILING APPARATUS

(76) Inventor: Bernard A. Li, P.O. Box 8705, Rancho Santa Fe, CA (US) 92067

( * ) Notice: Subject to any disclaimer, the term of this patent is extended or adjusted under 35 U.S.C. 154(b) by 0 days.

(21) Appl. No.: 09/443,600

(22) Filed: Nov. 19, 1999

(51) Int. Cl.[7] ..... A47L 13/16; A47L 25/00
(52) U.S. Cl. ..... 15/244.3; 15/244.1; 15/247
(58) Field of Search ..... 15/244.1, 244.3, 15/247; D28/51, 52, 63

(56) References Cited

U.S. PATENT DOCUMENTS

| | | | |
|---|---|---|---|
| D. 250,858 | | 1/1979 | Yamaguchi . |
| D. 294,886 | | 3/1988 | Lee . |
| D. 295,911 | | 5/1988 | Zogg . |
| D. 406,426 | | 3/1999 | Henrie . |
| 1,804,504 | | 5/1931 | Henderson . |
| 2,303,660 | * | 12/1942 | Schickel . |
| 2,316,878 | * | 4/1943 | Mandalou . |
| 2,491,274 | * | 12/1949 | McNeill . |
| 2,742,661 | | 4/1956 | Carvalho . |
| 3,164,853 | * | 1/1965 | Peeler . |
| 3,724,018 | * | 4/1973 | Sills . |
| 4,184,221 | | 1/1980 | Edwards . |
| 4,628,564 | * | 12/1986 | Youssef . |
| 4,945,599 | | 8/1990 | Flynn . |
| 5,077,857 | | 1/1992 | Sellers . |
| 5,799,357 | | 9/1998 | Taylor . |
| 5,855,214 | | 1/1999 | Heneghan . |
| 5,887,310 | | 3/1999 | Wright . |

FOREIGN PATENT DOCUMENTS

| | | | |
|---|---|---|---|
| 216903 | | 1/1925 | (GB) . |
| 92/04935 | * | 4/1992 | (WO) ..... 15/244.1 |
| PTC/US97/11652 | | 7/1997 | (WO) . |
| PTC/US97/11973 | | 7/1997 | (WO) . |

* cited by examiner

*Primary Examiner*—Randall E. Chin
(74) *Attorney, Agent, or Firm*—Fulwider Patton Lee & Utecht, LLP

(57) ABSTRACT

A detailing brush device having a handle formed with a stem mounting a conically foam cleaner brush and an absorbent sock received removably over the brush.

16 Claims, 1 Drawing Sheet

FIG. 1
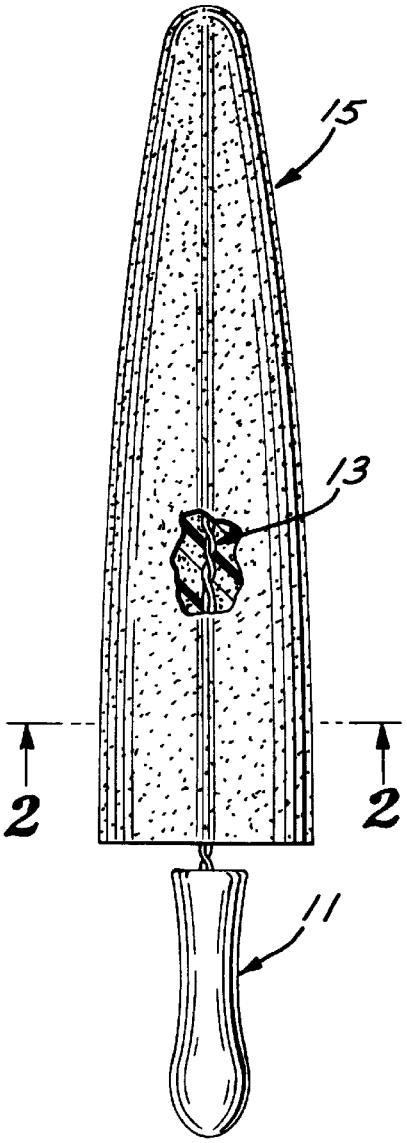
FIG. 3
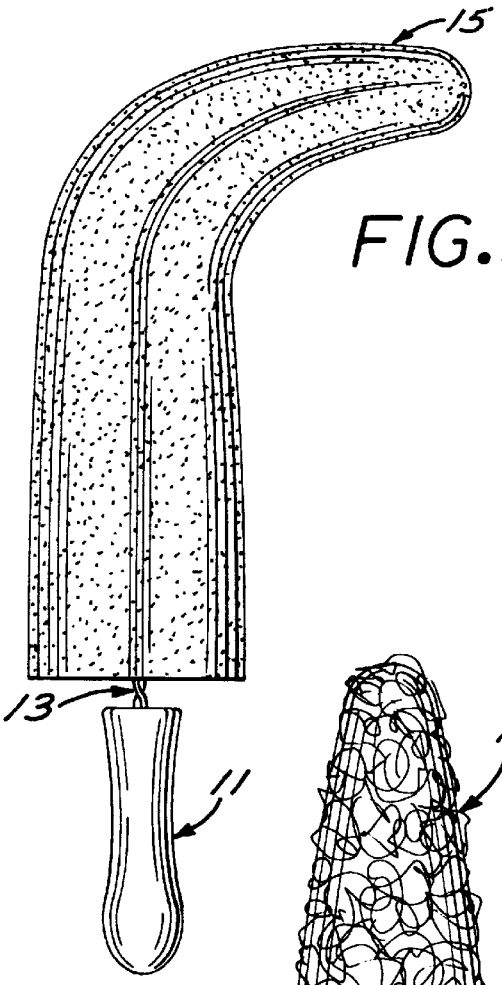
FIG. 2
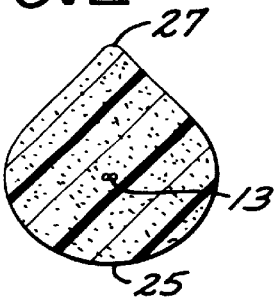
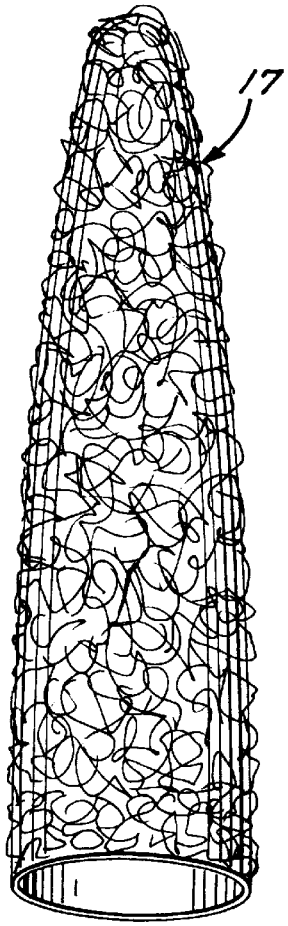
FIG. 4

WHEEL DETAILING APPARATUS

BACKGROUND OF THE INVENTION

1. Field of the Invention

The present invention relates to a brush style device for detailing hard to access holes and crevices in automotive wheels.

2. Description of the Prior Art

With the popularity of high end wheels having exotic and complicated shapes and high technology finishes, the cleaning and polishing of such wheels has become a challenge. The very objective of the purchaser in acquiring such wheels for their attractive appearance is often defeated by the fact that difficult to access crevices or openings are often left with dirt and residue which detract from the aesthetics of such wheels.

Over the years, many efforts have been made to provide a satisfactory device for cleaning and detailing wheels of various styles and shapes. It has been proposed to utilize long bristle brushes and/or sponges to clean the wheel. Such devices have been found relatively unsatisfactory for cleaning deep crevices and openings in wheels incorporating compound curvatures and shapes. Such wheels are often thus left with unsightly dirt or residue in areas which cannot be adequately cleaned or polished by tools presently available.

While considerable attention has been given to the development of wheel cleaning and polishing solutions, little attention has been given to the tool for applying such cleaning or detailing solutions. One cleaning tool has been proposed incorporating a double ended brush having a tapered foam sheath on one end and a combination bristle and plastic sponge on the other. A device of this type is shown in U.S. Pat. No. 5,077,857 to Sellers. Such a device, while satisfactory for certain applications, suffers the shortcoming that use thereof contemplates alternative gripping of the opposite ends of the tool by the user thus resulting in the user's hand becoming covered with dirt or detailing solution as the tool is reversed from end to end. Additionally, the core of the tool is rigid thus limiting the angle from which crevices and openings might be accessed.

SUMMARY OF THE INVENTION

The present invention is characterized by a multifunctional wheel cleaning and polishing tool incorporating on one end a handle having a stem projecting therefrom which mounts a conically shaped polyurethane foam brush for cleaning of a automobile wheel. A detailing sock is provided for selective fitting over such brush so that the foam brush may be utilized for cleaning of the vehicle with the sock being utilized for polishing the car. In another aspect of the inventions, the handle mounts a pliable wire stem having the foam brush mounted thereon in surrounding relationship and flexible to be bent in two different angular orientations with bending of the stem to thus provide various angular orientations for accessing openings, grooves and crevices in a wheel to be cleaned.

BRIEF DESCRIPTION OF THE DRAWINGS

FIG. 1 is a front view, partially broken away, of a wheel detailing tool embodying the present invention;

FIG. 2 is a transverse sectional view taken along the line 2—2 of FIG. 1;

FIG. 3 is a front view, similar to FIG. 1, but showing the brush portion of the tool bent; and FIG. 4 is a front view of an absorbent sock used with the tool shown in FIG. 1.

DETAILED DESCRIPTION OF THE PREFERRED EMBODIMENT

Referring to FIG. 1, the cleaning and detailing of the present invention includes, generally, a handle 11 having an elongated pliable wire stem 13 projecting from one extremity thereof and mounting thereabout a conically shaped foam brush 15. A terrycloth sock, generally designated 17 is configured to compliment the shape of the brush 15 so that a wheel can be cleaned by the foam brush 15 and thereafter, the sock 17 placed thereover for polishing of the cleaned wheel. In both instances, access can be had to the openings and crevices of different shapes and configurations in the wheel for thorough cleaning and polishing thereof.

In practice, the handle 11 is constructed of thermoplastic. The stem 13 is a twisted pliable wire so that it can be bent to various configurations. Such stem may be on the order of 18 cm long.

The foam brush 15 may be constructed of thermoplastics such as polyurethane foam or styrene or may be constructed of a composite of polyester and polyurethane. It is only important that it be in the form of a foam material for absorbing fluid for the cleaning procedure and be flexible and pliable to conform to the various radii of curvature for various rounded or sharp edged crevices. Such cleaner brush is generally conically shaped to taper distally and inwardly from its base towards its reduced in diameter tip. The foam is preferably formed on one lateral side with a generally rounded cross-sectional configuration to form a rounded surface 25 and on the opposite side with a triangular shape terminating in a point 27 to thus cooperate in providing somewhat of a tear drop cross-sectional shape (FIG. 2). This facilitates cleaning of rounded openings and crevices by the surface 25 and cleaning of sharper, pointed, or triangular sections by the point 27.

The polishing sock 17 is constructed of absorbent fiber material such as terrycloth and is configured with a generally conical shape to compliment the shape of the brush 15 and is configured to form a close-fit relationship therewith so as to hold the sock in position on such brush and prevent all around rotation relative to such brush or withdraw therefrom during the polishing procedure.

Terrycloth is a ideal material for such sock, it will be appreciated that any desirable polishing cloth, such as chamois or cotton would serve the purpose.

From the foregoing it will be appreciated that the cleaning and polishing tool of the present invention may be sold individually or in kit form with detailing solution or the like. If a user elects to clean and polish his automobile wheels, the wheels may be sprayed off with water and if desirable, the cleaning brush 15 submerged in cleaning solution and openings and crevices accessed by the relatively tip end to clean smaller radii of curvature indentations and openings and, larger through openings, the larger diameter base portion maybe employed. For sharp crevices and angular openings, the pointed edge 27 ( FIG. 2), of such brush may be drawn through such crevice to apply the cleaning fluid thereto and move dirt and residue therefrom. As will be apparent to those skilled in the art, the rounded side 25 of such brush will be utilized for the more rounded crevices and openings.

It is a problem with certain crevices and openings that dirt, graphite dust, and the like builds up on the backside of openings and crevices thus, presenting an unsightly darkened appearance to the periphery thereof. To remove such dust and grime, access must be had axially to the inner most portion of the openings and crevices and in many circumstances, to the backside thereof in order to fully remove the unsightly dirt to prevent such dirt and residue from migrating axially outwardly along the opening or crevice to the visible portion of the wheel after the cleaning process is completed. Thus, it is important to provide access axially to the inner most portions of such openings and crevices and also to the backside thereof. To this end, the twisted wire stem 13 can be bent at the distal extremity thereof as shown in FIG. 3 to thus provide a hook shape to the brush 15 so that access can be had to the inner most portion thereof and even to the backside of the wheel. The cleaning solution may be thus fully applied to the dust and grime and mechanically manipulated for dislodgement and removal thereof.

Once the cleaning process has been completed, it is important that the wheel be polished to totally bring out the luster of the finish thereof and provide the most aesthetically pleasing appearance of the detailed wheel. To this end, the polishing sock 17 will be inserted over the brush 15 and drawn firmly thereon so as to establish the close-fit relationship thereof and slightly compressing the foam material of the foam brush 15 radially inwardly to firmly hold the sock in position. With such sock in position, it will be appreciated that polishing or detailing solution can be applied and access can be had to all the openings and crevices previously visited by the foam brush 15 and that the brush may be bent to the hook position shown in FIG. 3 to allow complete polishing of all such openings and crevices of the wheel to provide the most desirable end appearance.

From the foregoing, it will be apparent to those skilled in the art that the automobile wheel cleaning and detailing tool of the present invention is of relatively inexpensive construction and provides for convenient access to nearly all openings and crevices of modem design wheels for thorough and complete cleaning and detailing thereof.

What is claimed is:

1. Wheel detailing apparatus for detailing a wheel comprising:

an elongated brush handle;

a stem projecting from one end of said handle;

a thermoplastic foam cleaning brush surrounding said stem and formed with a base adjacent said handle and configured with longitudinal side walls tapering distally and laterally inwardly to a reduced in cross section cleaning tip; and a polishing sock open on its base end and configured to compliment the shape of said brush and so configured as to be removably received in retained position on said brush whereby a user may grasp said handle and apply said brush to clean some portions of said wheel with the base of said brush and other portions with said tip and said user may further fit said sock on said brush and dry or polish said portions with said sock.

2. A detailing apparatus as set forth in claim 1 wherein:

said stem is flexible to be bent to hold said brush in selected different orientations.

3. A detailing apparatus as set forth in claim 1 wherein:

said brush is formed in cross section with a laterally facing surface rounded and an oppositely disposed lateral surface pointed.

4. A detailing apparatus as set forth in claim 1 wherein:

said brush is conically shaped.

5. A detailing apparatus as set forth in claim 1 wherein:

said brush in constructed of polyurethane.

6. A detailing apparatus as set forth in claim 1 wherein:

said brush is constructed of polyester polyurethane.

7. A detailing apparatus as set forth in claim 1 wherein:

said stem in constructed of twisted wire.

8. A detailing apparatus as set forth in claim 1 wherein:

said brush is tear drop shaped in lateral cross section.

9. A detailing apparatus as set forth in claim 1 wherein:

said sock in constructed of terrycloth.

10. A detailing apparatus as set forth in claim 1 wherein:

said brush in compressible; and said sock forms a close fit on said brush.

11. A wheel detailing and cleaning tool comprising:

an elongated brush handle;

a pliable stem projecting longitudinally from said handle; and an elongated thermoplastic foam cushion surrounding at least a portion of said stem and configured with a tear drop shaped cross section to form on one lateral side a rounded cleaning surface and on the opposite side a triangular cleaning surface, said foam cushion tapering from a large base gradually to a narrow tip.

12. A wheel detailing and cleaning tool as set forth in claim 11 wherein:

said pliable stem is constructed of bendable wire.

13. A wheel detailing and cleaning tool as set forth in claim 11 wherein:

said pliable stem is constructed of twisted wire.

14. A wheel detailing and cleaning tool as set forth in claim 11 wherein:

said thermoplastic foam is styrene.

15. A wheel detailing and cleaning tool as set forth in claim 11 wherein:

the thermoplastic foam cushion is constructed to be formed with the opposite lateral sides of said rounded cleaning surface curving longitudinally and laterally inwardly from said base towards said tip with said tip being rounded at the terminus thereof.

16. A wheel detailing apparatus for detailing a wheel comprising:

an elongated brush handle;

a stem projecting from one end of the handle;

a cleaning brush surrounding such stem and formed with a base adjacent the handle and configured to taper inwardly in the distal direction to a reduced in cross section tip; and a polishing sock open on its base end and configured to complement the shape of the brush and so configured as to be removably retained on the brush whereby a user may grasp the handle and apply the brush to clean some portions of the wheel with the base of the brush and other portions of the tip and the user may further fit the sock on the brush to dry or polish said portions of said wheel with the sock.

* * * * *